United States Patent [19]

Van Becelaere

[11] Patent Number: 4,911,065

[45] Date of Patent: Mar. 27, 1990

[54] DAMPER WITH OVERRIDE CONTROL

[75] Inventor: Robert M. Van Becelaere, Prairie Village, Kans.

[73] Assignee: Philips Industrial Components Inc., Dayton, Ohio

[21] Appl. No.: 336,034

[22] Filed: Apr. 11, 1989

[51] Int. Cl.[4] ..... F24F 11/00

[52] U.S. Cl. ..... 98/1; 98/42.15; 98/42.03; 236/49.2

[58] Field of Search ..... 98/1, 42.03, 42.15, 98/121.2; 236/49.2, 49.3

[56] References Cited

U.S. PATENT DOCUMENTS

| | | | |
|---|---|---|---|
| 4,039,123 | 8/1977 | Frankel | 236/1 G |
| 4,432,272 | 2/1984 | Van Becelaere | 98/1 |
| 4,463,896 | 8/1984 | Schaus | 98/1 X |

FOREIGN PATENT DOCUMENTS

| | | | |
|---|---|---|---|
| 964682 | 3/1975 | Canada . | |
| 1200461 | 2/1986 | Canada | 98/1 |
| 8642 | 1/1977 | Japan | 236/49.2 |
| 1038429 | 8/1966 | United Kingdom . | |
| 1516007 | 6/1978 | United Kingdom . | |
| 2084013 | 4/1982 | United Kingdom . | |

OTHER PUBLICATIONS

Rixson-Firemark, Inc. brochure entitled, "Automatic Damper Operator Model FM-5590" (1972).

*Primary Examiner*—Harold Joyce

*Attorney, Agent, or Firm*—Kokjer, Kircher, Bradley, Wharton, Bowman & Johnson

[57] ABSTRACT

A fire and smoke damper equipped with a thermal responsive electric switch for closing the damper responsive to the elevation of the ambient temperature above a first predetermined level. Control circuitry is provided for permitting selective override of the switch for opening the damper from a remote control panel so that toxic fumes and smoke may be vented through the damper. A second thermal responsive switch operable at a higher predetermined temperature is interposed in the control circuit to insure that the damper may not be opened by the override circuit in the event that such higher ambient temperature has been reached in the location of the damper.

10 Claims, 1 Drawing Sheet

DAMPER WITH OVERRIDE CONTROL

Figure 2:
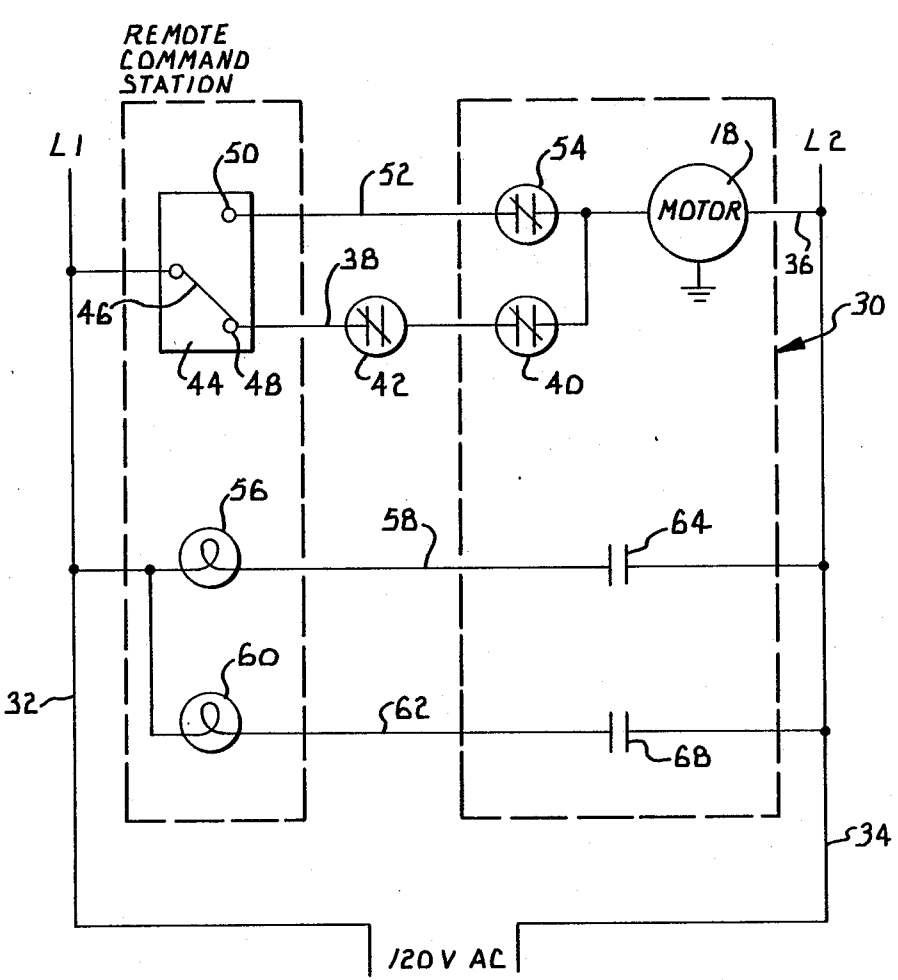

This invention pertains to air handling equipment, and more particularly to a fire or smoke damper which may be interposed in the heating or ventilating ducting of buildings to protect against the transmission of fire or smoke through such conduits in case of fire. Specifically, the subject of the present invention is the provision of a novel control which is operable in combination with existing fire and smoke dampers to furnish improved protection for buildings.

It is well known to provide fire and smoke dampers which are motor operated. Typically such dampers may be installed in various strategic locations throughout a building, usually during the construction of the building. The dampers are often held open by an actuator, motor, or a motor with associated brake or clutch components to permit deenergizing of the motor during standby service (all such devices are herein simply called "motors"). A temperature responsive device is associated with each damper to cause the damper to close automatically when the ambient temperature at the device reaches or exceeds a predetermined value.

Some dampers may be associated with a smoke responsive device which automatically closes the damper when smoke is sensed in the vicinity of the device. Still further, some dampers may be equipped with both smoke and temperature responsive devices so that the damper will be closed, either upon the ambient temperature reaching a predetermined value or smoke being sensed in the vicinity of the damper, or upon the sensing of both high temperature and the presence of smoke.

U.S. Pat. No. 4,432,272 issued Feb. 21, 1984 entitled "Motor Operated Fire Damper" describes and claims a damper of this type which is in general use. This patent, the disclosures of which are incorporated herein by reference, explains the construction and operation of such dampers wherein overriding control circuitry may be utilized for the selective energizing of the damper motor to open the damper after a temperature responsive electrical switch interposed in the motor circuit has caused the damper to automatically close. The patent describes conditions wherein such reopening of the damper may be highly desirable to control the venting of smoke and toxic fumes from a building through the building's heating or ventilation system.

While U.S. Pat. No. 4,432,272 is specifically concerned with fire dampers, those skilled in the art will readily recognize that the principles apply equally to dampers constructed to automatically close in the presence of smoke or both smoke and elevated temperature. Further, these principles may apply to dampers with motors which are operated from the building's pneumatic system, rather than from the electric system, in which case the electric controls operate valves which energize and deenergize the damper motors rather than operate the motors directly.

Dampers of the type described in U.S. Pat. No. 4,432,272 are in widespread use today and offer those responsible for safety in buildings the opportunity for venting hazardous fluids by overriding the temperature responsive damper closing switches through suitable control circuitry. Concern has arisen, in certain constructions, where this type of damper is used, that the reopening of the dampers by the overriding control, at locations where extremely high temperatures are present, may cause, unnecessary damage. The opening of the damper under these conditions could permit the fire to spread and this would more than offset the benefits which would be derived from venting toxic fumes and smoke from the vicinity.

This problem is particularly exacerbated by the fact that the controls to override the damper closing switches are usually located at a central station remote from the actual location of the dampers involved. The operator cannot know the actual conditions in the vicinity of the damper when he may elect to open a closed damper. Such opening of the damper in the face of extreme high temperatures could inadvertently but tragically spread the fire.

Accordingly, it is the primary object of the present invention to provide an improved damper and control system wherein a damper which has automatically closed responsive to smoke or heat is automatically incapacitated from reopening in the presence of temperatures exceeding a predetermined value higher than the normal closing temperature of the damper.

It is a further object of the present invention to provide a damper and control of this type wherein the damper may be readily selective reopened to evacuate fumes and smoke when the ambient temperature at the damper is below such higher temperature.

Still a further object of the present invention is to provide such a damper and control wherein the operator at a remote control station need not know the ambient temperature at the damper in order to avoid inadvertent reopening of a closed damper at locations where the temperatures are sufficiently high as to cause damaging results.

Another object of this invention is to provide such a damper and control combination wherein the foregoing objectives may be achieved without foregoing the advantages of convenience, economy and reliability of electrical controls for the damper.

Figure 1:
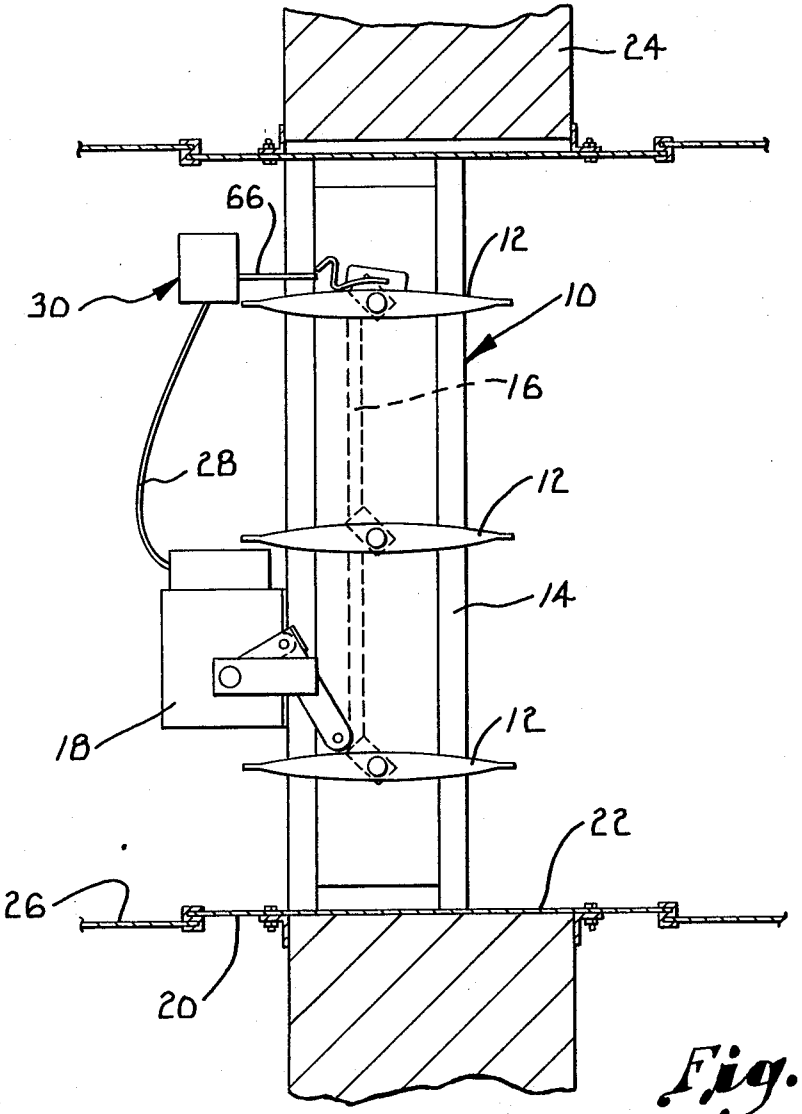

These and other important aims and objectives of the present invention will be further explained or will be readily apparent from the following explanation and description of the drawing, wherein:

FIG. 1 is a detailed vertical cross-sectional view through a typical damper embodying the principles of this invention; and FIG. 2 is a fragmentary schematic view of the control circuitry for the damper of FIG. 1.

A typical damper installation utilizing the principles of this invention is illustrated in FIG. 1. A damper 10 has a plurality of blades 12 each pivotally mounted in a peripheral frame 14 and interconnected by linkage 16 operated by electrically operated means in the nature of a motor or actuator 18 secured to frame 14. Linkage 16 pivotally interconnects blades 14 so that they may be operated in unison between the opened position of the damper as illustrated in FIG. 1 to a closed position with the blades 12 rotated 90° from that shown so that they form a barrier blocking the flow of fluid through the damper.

Typically, the damper is mounted in a peripheral tube or sleeve 20 which may be telescoped through an opening 22 in a wall 24. The ends of sleeve 20 register with and are secured to the proximal ends of the duct 26 which may comprise a portion of the building's heating or air conditioning system.

Damper 10 as hereinabove explained is entirely conventional and forms no part of the present invention per se. However, motor 18 is electrically coupled through a flexible cable 28 to a novel control unit 30 which is preferably mounted on the internal surface of sleeve 20 in close proximity to damper 10 as shown in the drawing. The internal components of control unit 30 are more clearly illustrated schematically in FIG. 2 as comprising a part of the electrical circuitry for controlling and operating damper 10.

Lines 32 and 34 are the power lines of a 120 volt AC fused circuit and provide the electrical power for operating the damper of this invention. Motor 18 is operably coupled to lines 32 and 34 by a lead 36 and a line 38. A first, normally closed, thermal responsive switch 40 is interposed in series in line 38 as shown in the drawing. Preferably also, a normally closed smoke responsive switch 42 is connected in line 38 in series with switch 40. It will be readily understood by those in the art that switch 40 is of a type having a bi-metallic switch element capable of deforming to open the switch responsive to the elevation of the ambient temperature above a predetermined level. Further, switch 42 may be of the ion chamber type commonly referred to as a "smoke detector" readily available commercially, or switch 42 may be of any other suitable type capable of operating the switch to its open position responsive to the presence of a significant amount of smoke in the vicinity of the switch.

A three position manually operable switch 44 is also interposed in line 38 as shown in FIG. 2. The pole piece 46 of switch 44 connects line 38 with line 32 through switch contact 48. A second contact 50 of switch 44 is connected with a line 52 extending in parallel with line 38. A second normally closed thermal responsive switch 54 is interposed in series in line 52 between switch 50 and motor 18 as shown. Switch 54 may be substantially similar to switch 40 with the exception that switch 54 has the inherent characteristic of opening at a temperature higher than the operable temperature for switch 40. It will be understood that the switches of this type having any of a wide range of operating parameters are readily available commercially.

Preferably, a signal lamp 56 to indicate the closed blade position of the damper is operably coupled to lines 32 and 34 by a line 58 and a lamp 60 to indicate the open condition of the damper blades is connected to lines 32 and 34 by a line 62. A normally open switch 64 in control unit 30 is operated by a switch arm 66 in disposition to be engaged by the damper components to close the switch when the damper blades are in the closed position. Similarly, a normally open switch 68 in line 62 and physically located in control unit 30 is also operated by arm 66. The damper components move the switch arm to a position closing switch 68 and opening switch 64 when the damper blades are in the open position illustrated in FIG. 1. Switch 68 is opened and switch 66 is closed when the blades are in their closed positions.

In operation, manual switch 44 and lights 56 and 60 are usually located at a remote command station which may be at a central location for a building in which damper 10 may be installed. Switch 44 normally has its pole piece 46 in the position shown in FIG. 2, thereby providing a source of electrical power for operating motor 18 to hold the blades in their open positions. The first thermal responsive switch 40 and switch 42 are normally closed so that power is supplied to the motor through line 38.

In the event of a fire creating a significant amount of smoke in the vicinity of switch 42, this switch opens to terminate the electrical power to motor 18. Fire dampers of the type shown are normally biased to a condition with the blades in their closed or flow blocking positions. This may be accomplished by an internal spring in motor 18, a spring associated with the vane or linkage of the damper, or by some gravity operated device. The deenergizing of motor 18 permits the damper blades to assume the closed position. When the blades are closed, the flow of fluid through the opening defined by the damper is interrupted. This condition is indicated at the remote command station by the illumination of lamp 56 as will be readily understood.

Manifestly, if a fire is in the immediate vicinity of the damper, the ambient temperature very likely would be sufficiently high to open switch 40. It should be pointed out that the control circuitry for damper 10 may, if desired, eliminate switch 42 so that the damper would be closed only by the temperature achieving the operating temperature parameter for switch 40 rather than by the presence of a significant amount of smoke. While switch 40 may be chosen to have an operating temperature at any valued desired, it has been found that an operating temperature of at least 165° F. is desirable, but an operating temperature of at least 212° F. is preferred.

If the operator charged with safety in the building desires to use the building ventilation system for removing toxic fumes or smoke from the building, he can override the closing of the damper by moving the pole piece of switch 44 to contact 50, thereby reenergizing motor 18 blades through line 52 to open the damper. Assuming that the fire is not in the immediate proximity of the damper, this would ordinarily be a prudent practice. However, as mentioned above, if the fire is near to the damper, the opening of the damper to permit the passage of super heated air through the duct at extremely high temperature would probably do more harm than good. It would very likely serve to spread the fire further through the building.

Accordingly, the second thermal responsive switch 54 serves to protect against the opening of the damper in the event that the ambient temperature in the proximity of the damper has reached a second predetermined value. The internal characteristics of switch 54 are preferably chosen so that the normally closed switch will open if the temperature becomes elevated to a dangerously high value. While any particular safety temperature might be chosen, it has been found that an operating temperature for switch 54 should probably be a least 250° F. Under certain conditions, the operating temperature may be as much as 350° F. or, for that matter, 450° F. or higher. Both switches 54 and 40 are preferably of a type that automatically reset to their respective closed conditions when the ambient temperatures cool significantly below the operating temperatures for the switches.

It will be readily apparent to those skilled in the art that the damper and control circuitry of this invention permits the safe overriding of fire and smoke dampers of the type described with such overriding option being eliminated when the ambient temperatures at the damper equal or exceed a dangerous temperature determined by the predetermined parameters chosen for switch 54.

While the principles of this invention have been described with respect to a particular, multi-vaned damper operated by an electric motor, it will be readily apparent to those skilled in the art that these principles can be applied to any of a wide variety of dampers, including those with motors operated through electrical valving from the pneumatic system of a building.

Having disclosed the invention, what is claimed is:

1. A control circuit and damper combination for controlling the flow of fluid through a building conduit, said combination comprising:

a damper including a frame mounted barrier normally in a position blocking fluid flow through the damper and movable to an open position permitting fluid flow through the damper;

electrically operated means coupled with the barrier and adapted to be coupled with a source of power for moving the barrier to said open position;

first internal thermal responsive switch means in relatively close proximity to the damper, said first switch means being operably coupled with said electrically operated means to permit the latter to remain energized to hold the barrier in said open position when the ambient temperature at said first switch means is below a first predetermined level and to deenergize said electrically operated means to permit the barrier to move to said flow blocking position when the ambient temperature at said first switch means is elevated to or above said first predetermined level;

overriding control circuitry operably coupled with said electrically operated means and adapted to be coupled with said power source to permit optional energizing of said electrically operated means to open the barrier irrespective of operation of said first switch means to deenergize said electrically operated means; and second thermal responsive switch means in relatively close proximity to the damper, said second switch means being operably coupled with said overriding control circuitry to permit the operation of the control circuitry when the ambient temperature at said second switch means is below a second predetermined level higher than said first predetermined level, and to prevent the operation of said overriding control circuitry when the ambient temperature is at or above said second predetermined level.

2. The invention of claim 1, wherein said second thermal responsive switch means includes a bi-metallic switch element capable of deforming to open the switch responsive to the elevation of the ambient temperature above said second predetermined level.

3. The invention of claim 2, wherein said first thermal switch means is substantially similar to said second thermal responsive switch means, but is constructed to open at said first temperature.

4. The invention of claim 1, wherein a normally closed smoke responsive switch means is electrically connected in series with said first thermal responsive switch means, said smoke responsive switch means being capable of opening when a significant amount of smoke is present, thereby deenergizing said electrically operated means to permit the closing of the damper.

5. The invention of claim 1, wherein said overriding control circuit is electrically connected in parallel with said first thermal responsive switch means, and wherein said second thermal responsive switch means is electrically connected in series in said overriding control circuit.

6. The invention of claim 1, wherein said first temperature is at lest 165° F.

7. The invention of claim 1, wherein said first temperature is about 212° F.

8. The invention of claim 6, wherein said second temperature is at least about 250° F.

9. The invention of claim 6, wherein said second temperature is at least about 350° F.

10. The invention of claim 6, wherein said second temperature is at least about 450° F.

* * * * *